US005664698A

United States Patent [19]

Nottingham et al.

[11] Patent Number: 5,664,698

[45] Date of Patent: Sep. 9, 1997

[54] CONFECTION DISPENSER DEVICE

[75] Inventors: John Nottingham, Hunting Valley; John Spirk, Gates Mills; Paul Tamulewicz, Berea; Patrick Brown, Strongsville; Douglas Gall, Westlake, all of Ohio

[73] Assignee: Nottingham-Spirk Design Associates, Inc., Cleveland, Ohio

[21] Appl. No.: 545,522

[22] Filed: Oct. 19, 1995

[51] Int. Cl.[6] ..... G07F 13/00

[52] U.S. Cl. ..... 222/2; 222/333; 222/368

[58] Field of Search ..... 222/2, 154, 167, 222/333, 410, 369, 368, 318, 414, 169–172; 221/258, 265, 266

[56] References Cited

U.S. PATENT DOCUMENTS

| | | | |
|---|---|---|---|
| 2,209,461 | 7/1940 | Kunkel | 222/333 |
| 2,846,122 | 8/1958 | Jenkins et al. | 222/2 |
| 3,272,300 | 9/1966 | Hoenisch | 222/369 |
| 3,894,657 | 7/1975 | Eckmayr | 221/265 |
| 4,729,493 | 3/1988 | Cole et al. | 221/265 |
| 4,997,405 | 3/1991 | Dabrowski | 221/265 |
| 5,232,130 | 8/1993 | Woodard | 222/464 |
| 5,356,035 | 10/1994 | Shlopak et al. | 222/78 |
| 5,385,267 | 1/1995 | Diamond et al. | 221/248 |

*Primary Examiner*—Andres Kashnikow
*Assistant Examiner*—Philippe Derakshani
*Attorney, Agent, or Firm*—Vickers, Daniels & Young

[57] ABSTRACT

A confection dispenser for dispensing confectionery pieces in a visually interesting and unique manner. The confection dispenser includes a confection chamber which holds the confectionery pieces and further includes a conveyance mechanism which transports the confectionery pieces from the confection chamber to an opening in the dispenser in a unique and interesting way. The confectionery dispenser may be sized such that it is portable and/or can include a bank wherein a user deposits a coin into the dispenser to activate the dispenser thereby obtaining confectionery pieces and further saving money for further use.

17 Claims, 7 Drawing Sheets

CONFECTION DISPENSER DEVICE

The present invention relates to generally a dispensing device and more particularly to an ornamental dispenser for candy pieces.

BACKGROUND OF THE INVENTION

Various types of confectioneries, particularly candy and gum, have gained wide popularity with children and adults alike. These confectioneries have been sold individually in drugstores and through various types of dispensers, commonly located in grocery stores and drugstores. Dispensers of individual pieces of candy and gum are particularly popular with children. Numerous such devices exist in which a coin is inserted into the device to dispense a piece of candy or gum. One popular type of candy dispensing device commonly found in a child's home is a form of a savings bank wherein a child dispenses a piece of gum by depositing a coin into the dispenser and obtains a gumball. The deposited coin is stored in a secured compartment in the dispenser which performs the function of a small savings account for the child. Candy dispensers have also been made in the form of toy characters and figures such as dolls. Such dispensers are commonly filled up with pieces of candy or gum and include a single opening to allow the child to remove the candy or gum from the interior of the toy figure. One such ornamental candy dispenser is disclosed in U.S. Pat. No. 5,356,035. Other types of dispensers have been designed to incorporate challenging ways to dispense material from the container. Such designs are classified as puzzle type dispensers which challenges the individual to determine how to dispense foods contained in the dispenser. One such design is disclosed in U.S. Pat. No. 5,232,130.

One of the difficulties with designing a dispenser is to create a design which is popular for both children and adults alike and will maintain the interest in the dispenser over time. Typically, the dispenser design is simplistic which draws little interest to the dispenser after it has been used one or two times. As a result, these dispensers are commonly disposed of after a short period of use and/or are completely ignored after a short period of time. The construction of a dispenser which incorporates an interesting and an ingenuitive design and maintains an interest over a period of time presents challenges in terms of designing, low cost, and ease of operation, which can be easily manipulated by children and adults alike.

SUMMARY OF THE INVENTION

The present invention relates to a confectionery dispenser for dispensing candy, gum, nuts or other food products (hereinafter will be collectively referred to as "confectionery pieces") by a utilizing and interesting and creative design.

In accordance with the preferred embodiment of the present invention, a dispenser is provided which includes a housing. Within the housing there exists a confection chamber for holding confectionery pieces. The chamber is preferably cylindrical in shape and includes an outer radial edge and a first and a second side surface. A central axis is defined through the chamber wherein a chamber central axis passes through the first and second side surface of the chamber. The confection chamber includes a confection reservoir designed to hold confectionery pieces. The one of the side surface preferably includes a door which provides a passage through the dispenser housing and is designed to allow the confection reservoir to be refilled with confectionery pieces. The two side surfaces may be flat and/or include a curved surface or some other designed surface to enhance the aesthetic qualities of the dispenser. A dispenser opening is included in the housing of the dispenser to dispense confectionery pieces conveyed from the confection reservoir to the opening. A conveyance mechanism is incorporated within the housing of the dispenser to move confectionery pieces from the confection reservoir to the dispenser opening. The conveyance mechanism is designed to move the confectionery pieces in a visually interesting manner. The conveyance mechanism includes a rotating confection carriage which is preferably positioned inside the confection chamber. The confection carriage is mounted to rotate about the confection chamber central axis. A drive mechanism such as an electric motor or spring is incorporated in the dispenser to rotate the confection carriage and convey the confection from the confection reservoir to the dispenser opening.

In accordance with another feature of the present invention, the confection carriage includes one more carriage members. The confection carriage also includes one or more carriage wells which are designed to be loaded with confectionery pieces and convey such pieces to the dispenser opening. The confection wells can be formed by several different arrangements. One preferred arrangement, the confection carriage is made of two disc shaped members in a spaced relationship to each other. The width of the two disc members is preferably less than the thickness of the confection chamber to allow the confection carriage to easily rotate within the confection chamber. Each of the two members has a different radius. The first member has a radius which is less than the cross-sectional radius of the confection chamber. The second member has a radius less than the radius of the first member. Preferably, the difference in radii of the two members is at least ¼ inch. One or more carriage partitions are mounted between the members to maintain the members in proper alignment to each other. The carriage partitions preferably have a width generally equal to the width of the two members. The carriage partitions are preferably mounted generally perpendicular to the outer surface of each member and are generally aligned parallel to the confection chamber central axis. One or more carriage partitions can be substituted for a carriage ramp. A carriage ramp is mounted similar to a carriage partition except the carriage ramp is mounted so as to form an angle to the chamber central axis which is between 0–90 degrees. Preferably, the angle is between 25–75 degrees. A carriage well is formed by two spaced carriage partitions and/or carriage ramps. The confection well is designed to hold a set quantity of a confectionery piece such as a single gumball, several M & M's, etc. The confection carriage includes a slot which provides a passageway between the candy reservoir and the carriage well so that the confection pieces may pass from the candy reservoir to the confection well and then be carried to the dispenser opening. The confection carriage may also include a carriage back which connects one or both carriage members to a shaft located generally at the central axis of the confection chamber. The carriage back may include a design which increases the aesthetically pleasing effect of the dispenser during operation.

In accordance with another aspect of the present invention, the confection carriage includes a single carriage member and two or more carriage partitions extending perpendicularly from the face of the member. The member is generally disc shaped. The member includes an outer or peripheral edge which is generally circular in shape and has a radius which is less than the radius of the interior edge of the confection chamber thereby allowing the confection carriage to freely rotate within the confection chamber. The outer or peripheral edge may include one or more sprockets. The sprockets are designed to engage a gearing mechanism for rotating the confection carriage. The inner edge of the rotating chamber is also preferably circular in shape and includes a radius which is less than the radius of the outer edge of the rotating chamber. Preferably, the radius of the outer edge is at least ¼ inch greater than the radius of the inner edge. The carriage partitions have a height which is less than the width of the confection chamber to allow the carriage to rotate within the chamber. The carriage wells in the carriage are formed by two partitions positioned adjacent to one another. Preferably, the partitions are spaced 0.5–3.0 inches apart. A well base may be attached between two partitions to prevent the confectionery pieces from contacting the inner edge of the confection chamber. The carriage member may include a design to make the member more aesthetically pleasing during operation of the dispenser. In accordance with yet another aspect of the present invention, the dispenser includes a base structure connected to the confection chamber. Preferably, the base structure supports the confection chamber. The base structure includes a chamber which houses a motor mechanism and/or coin chamber. The base structure may be provided with a bottom which is generally flat to provide stability to the dispenser when placed upon a flat surface. If the base structure includes a coin chamber, the chamber is designed to store coins which have been used to activate the conveyance mechanism to dispense the confectionery pieces. The confection chamber may be mounted to the base structure in a number of different ways. Preferably, the confection chamber is mounted such that the central axis of the chamber lies in a plane parallel to the plane of the flat bottom of the base structure. However, it will be appreciated that the confection chamber may be mounted such that the central axis lies in a plane perpendicular to the plane of the bottom of the base structure or some angle therebetween.

In accordance with still yet another aspect of the present invention, the dispenser housing is made of an opaque or transparent material. The transparency of the material allows for an individual to visually observe the dispensement of confectionery pieces. Materials such as plastic or glass may be used to create a translucent dispenser. The dispenser opening, the conveyance mechanism and/or confection carriage may also include opaque or transparent parts to allow the user to visualize the actual conveyance of the confectionery pieces from the confection reservoir to the dispenser opening. Designs can be included upon the various elements of the dispenser to further enhance the visual qualities and effects of the dispenser.

In accordance with another aspect of the present invention, a coin slot and coin passage are incorporated into the frame of the dispenser. The coin slot is preferably positioned at the top or side of the dispenser and is sized to allow various types of coins to be inserted therethrough. Upon insertion of a coin through the coin slot, the coin enters a coin passageway and proceeds through the coin passageway into the coin compartment preferably located in the base structure of the dispenser. Preferably, a coin detector is located within the coin passageway to detect the passage of a coin through the passageway thereby activating the drive mechanism which rotates the confection carriage within the confection chamber to dispense the confection pieces through the dispenser opening. The use of a coin slot and a coin passageway with the dispenser transforms the dispenser into a confection coin bank dispenser.

In accordance with still yet another aspect of the present invention, the drive mechanism which moves the confection carriage includes a control mechanism for limiting the movement of the carriage to only one revolution around the central axis of the confection chamber upon activation. The dispenser is designed such that within the one rotation cycle, the confection carriage is filled with confectionery pieces in the confection well and the confection carriage is moved to a point whereby the confection is deposited through the dispenser opening. If an electric motor is used for the drive mechanism, the regulation of the electric motor is preferably accomplished by using a circuit breaker to start and stop the motor.

In accordance with another aspect of the present invention, the drive mechanism for moving the confection carriage is connected to a switch which can be directly actuated by the operator of the dispenser. Preferably, the switch is a button, which upon pressing by the operator, activates the drive mechanism until the button is released or until a single preset cycle has been completed by the conveyance mechanism.

In accordance with yet another aspect of the present invention, the dispenser opening includes a housing which forms a closure about the opening compartment. The housing is designed to maintain the dispensed confectionery pieces from freely spilling out from the dispenser opening. The housing is sized to hold at least one delivery of a confectionery pieces from the conveyance mechanism. The housing preferably includes an upper and a lower chamber and a lower shelf. The lower chamber may include a ramp section to facilitate the deposition of the confection from the housing.

It is the object of the present invention to provide a storage and dispensing device which can dispense confections.

It is another object of the present invention to provide a device which is ornamental in design and dispenses confections in a visually interesting manner.

It is yet another object of the present invention to provide a device which can be effectively manufactured at a reasonable cost and which can be safely operated by children and adults alike.

It is still another object of the present invention is to provide a confection dispenser which can be refilled and used more than once.

It is another object of the present invention is to provide a device for dispensing confections which is inexpensive to manufacture and which is easy to operate by adults and children.

It is a further object of the present invention to provide an ornamental design and visually intriguing conveyance mechanism for dispensing candy which provides entertainment and visual enjoyment to children and adults alike.

It is still another object of the invention to provide a dispenser with one or more opaque or transparent parts to allow the internal mechanisms and compartments of the dispenser to be observed, especially during the operation of the dispenser.

It is still yet another object of the present invention is to provide a coin activated conveyance mechanism wherein the confection is dispensed from the dispenser upon insertion of a coin to a coin slot.

It is still another object of the present invention to provide a coin retention compartment within the dispenser to serve as a coin receptacle when coins are used to activate the conveyance means of the dispenser thereby having the dispenser additionally function as a coin bank.

These and other objects and advantages will become apparent to those skilled in the art upon reading the following description taken together with the accompanying of the drawings.

BRIEF DESCRIPTION OF THE DRAWINGS

Reference may now be made to the drawings, which only illustrate various embodiments that the invention may take in physical form and in certain parts and arrangement of parts wherein.

DETAILED DESCRIPTION OF THE PREFERRED EMBODIMENT

Figure 1:
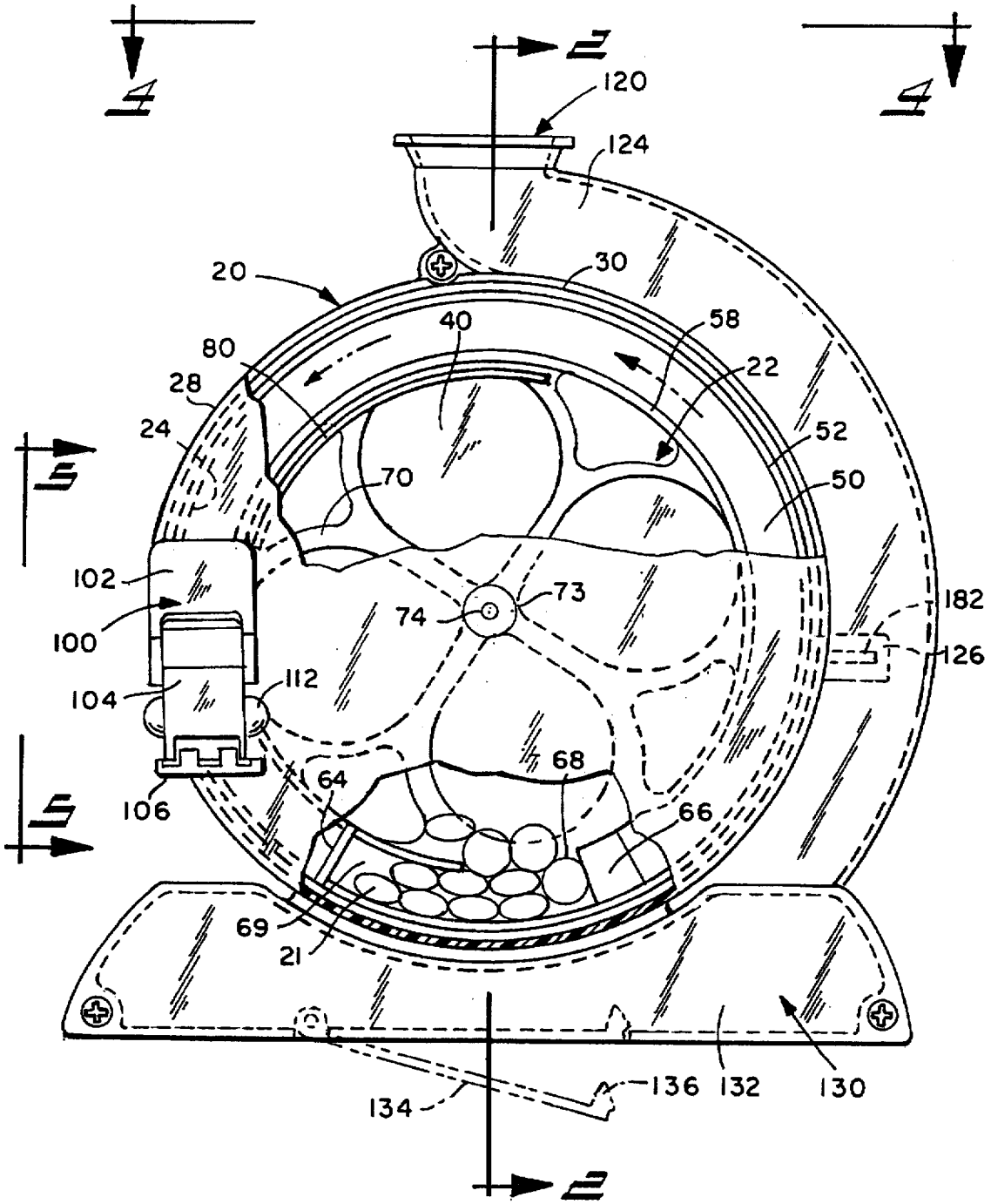
FIG. 1 is a partial sectional elevation view of the confection dispenser described herein.
Figure 2:
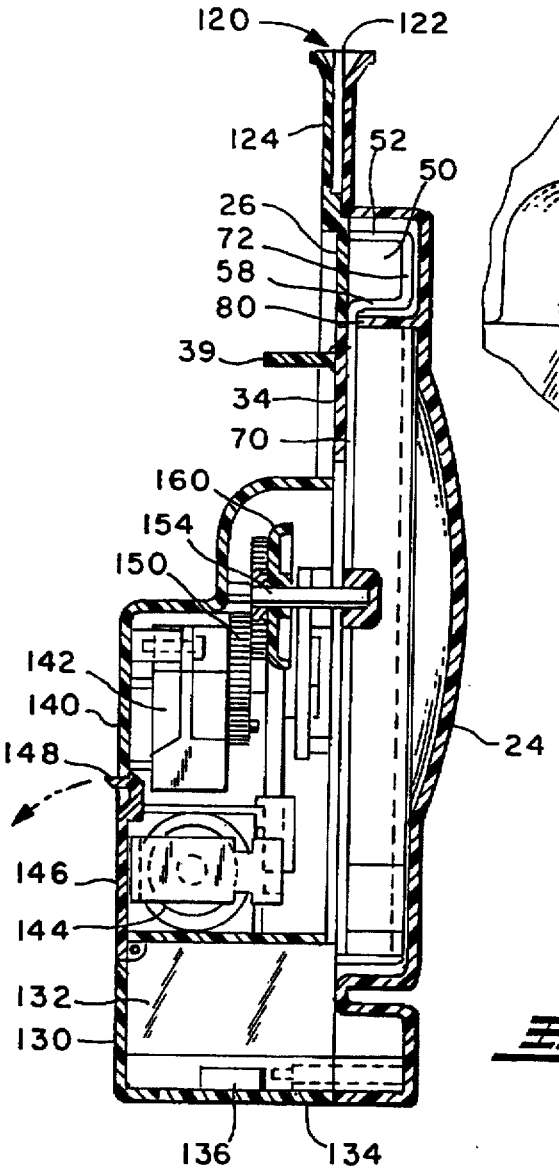
FIG. 2 is a cross-sectional view taken along line 2—2 of FIG. 1.

Referring now to the drawings, wherein the showings are for the purpose of illustrating the preferred embodiments of the invention only and not for the purpose of limiting the same, in FIG. 1 there is shown a confection dispenser 20 designed to dispense confectionery pieces to a user upon activation. Dispenser 20 includes a confection housing 22 and a bank housing 130 which is designed to support confection housing 22. Housing 22 is made up of a durable material. Preferably, the material is a clear or semi-opaque material so as to allow an operator to visualize the operation of dispenser 20. The confection housing includes a front face 24, a back face 26 and an outer surface 28. The front and back face may be flat, domed shaped, etc. As shown in FIG. 2, front face 24 includes a dome in the center of the face and back face 26 is flat. The housing is preferably connected together by one or more screws, however, other means for securing the housing together such as locks, glue, etc. can also be used. A confection chamber 30 is located within confection housing 22 and is designed to hold confectionery pieces 21. Back face 26 includes a confection door 34 which provides an access to chamber 30 to allow a user to fill confection reservoir 40 with confectionery pieces 21. Door 34 includes a handle 39 which upon being depressed by a user, releases door latch 38 to open the door. Chamber 30 is preferably designed to have a circular cross-section of some given radius, a central axis and a chamber width; however, other cross-sectional designs may be used. The width of chamber 30 is preferably 0.5–2 inches and the given radius is preferably 1–6 inches, however, the width and/or the given radius can be varied beyond such dimensions.

Chamber 30 includes a confection carriage 50 which is rotatably mounted within chamber 30. Carriage 50 is designed to transport confectionery pieces 21 from reservoir 40 to dispenser opening 90; the operation of which will be later described below. As shown in FIG. 1, carriage 50 includes two disc shaped members 52, 58. The width of the two members is slightly less than the width of chamber 30. The radius of member 52 is sized to be slightly less than the given radius of the cross-section of chamber 30. Preferably, the radius of member 52 is 0.5–6 inches; however, other dimensions may be used. The radius of member 58 is sized to be less than the radial cross-section of outer wall 52. Preferably size differential of the radii of the two members is about 0.25–1.0 inches, but other dimensions may be used. As shown in FIG. 1, member 58 is connected to carriage back face 70. Carriage back face 70 may be a solid face or made up of one or more carriage support bars as illustrated in FIG. 1. Carriage back face 70 includes a carriage connection member 73 which is preferably located in the center of carriage back face generally at the central axis of chamber 30. Connection member 73 includes a member hole 74 which is in turn connected to carriage shaft 154.

Carriage 50 includes one or more carriage partitions 64 connected between member 52 and member 58. The partitions connect the two members together and further provide structural support for the two walls. Carriage partition 64 is mounted perpendicular to the surface of the two members and is aligned generally parallel to the central axis of chamber 30. As illustrated in FIG. 1, a carriage ramp 66 is mounted in carriage 50 adjacent to carriage partition 64. Carriage ramp 66 is mounted between the two members and is aligned to form an angle which is non-parallel to the central axis of chamber 30. The angular mounting of carriage ramp 66 facilitates in depositing confectionery pieces 21 through opening 90 as described in more detail below. Ramp 66 also provides support to and a connector between members 52, 58. Carriage 50 preferably includes a front face 72 to connect the two members together and assure a constant spacing relationship between the two members. The front fact may be solid or include some design. Carriage 50 includes at least one carriage well 69 which is formed between carriage partition 64 and carriage ramp 66 as shown in FIG. 1. It will be appreciated that well 69 can be formed by two partitions 64 or two ramps 66. The spacing between the two partitions and/or ramps is preferably about 0.25–3 inches, however, other dimensions may be used. A carriage slot 68 is located in member 58 and closely adjacent to carriage ramp 66 to provide an access to well 69 thereby allowing confectionery pieces 21 in reservoir 40 to pass into well 69.

Chamber 30 includes a chamber shelf 80. Chamber shelf 80 is mounted below and closely adjacent to member 58. The radius of curvature of shelf 80 is selected to be slightly less than the radius of curvature of member 58. Shelf 80 is positioned in chamber 30 such that it extends at least from the top of chamber 30 to dispenser opening 90; however, it can be appreciated that the length of the shelf may be greater. Shelf 80 is designed to prevent all confectionery pieces 21 from dropping out of well 69 through slot 68 and into reservoir 40 prior to the confectionery pieces being deposited out through dispenser opening 90; the operation of which will be described in more detail below.

Figure 5:
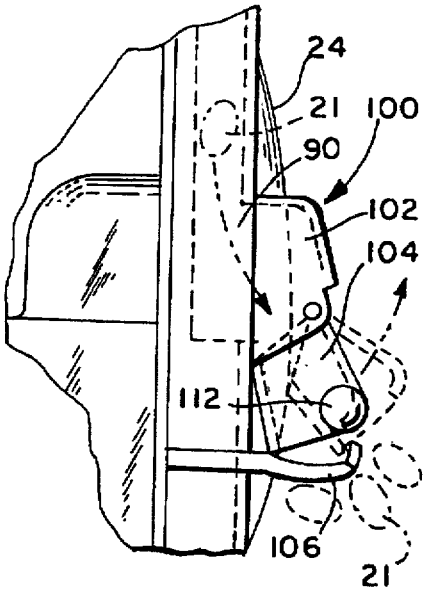
FIG. 5 is a side view taken along line 5—5 of FIG. 1.

Dispenser opening 90 is positioned on front face 24 of housing 22 and is positioned closely adjacent to outer surface 28. Dispenser opening 90 provides an access to confection chamber 30 and carriage 50. The size of the dispenser opening is preferably selected to be at least as wide as the spacing between the members 52 and 58. A dispenser housing 100 is mounted on front face 24 to cover dispenser opening 90. Dispenser housing 100 includes an upper chamber 102, a lower chamber 104 and a lower shelf 106. Upper chamber 102 generally covers the face of dispenser opening 90 and lower chamber 104 is positioned generally below dispenser opening 90 as shown in FIG. 5. Both the upper chamber and lower chamber include a passageway to allow confection pieces which are dispensed through opening 90 to pass into upper chamber 102 and to continue into lower chamber 104. Lower shelf 106 is positioned below lower chamber 104 to maintain dispensed candy in lower chamber 104. Lower chamber 104 is pivotally attached to upper chamber 102. This pivotal attachment allows lower chamber 104 to be moved relative to upper chamber 102 and lower shelf 106 to allow a user to access confectionery pieces 21 which has been deposited in lower chamber 104. As shown in FIGS. 1 and 5, lower chamber 104 includes two nodules 112 which provide a grasping surface for the user to easily move the lower chamber.

Figure 3:
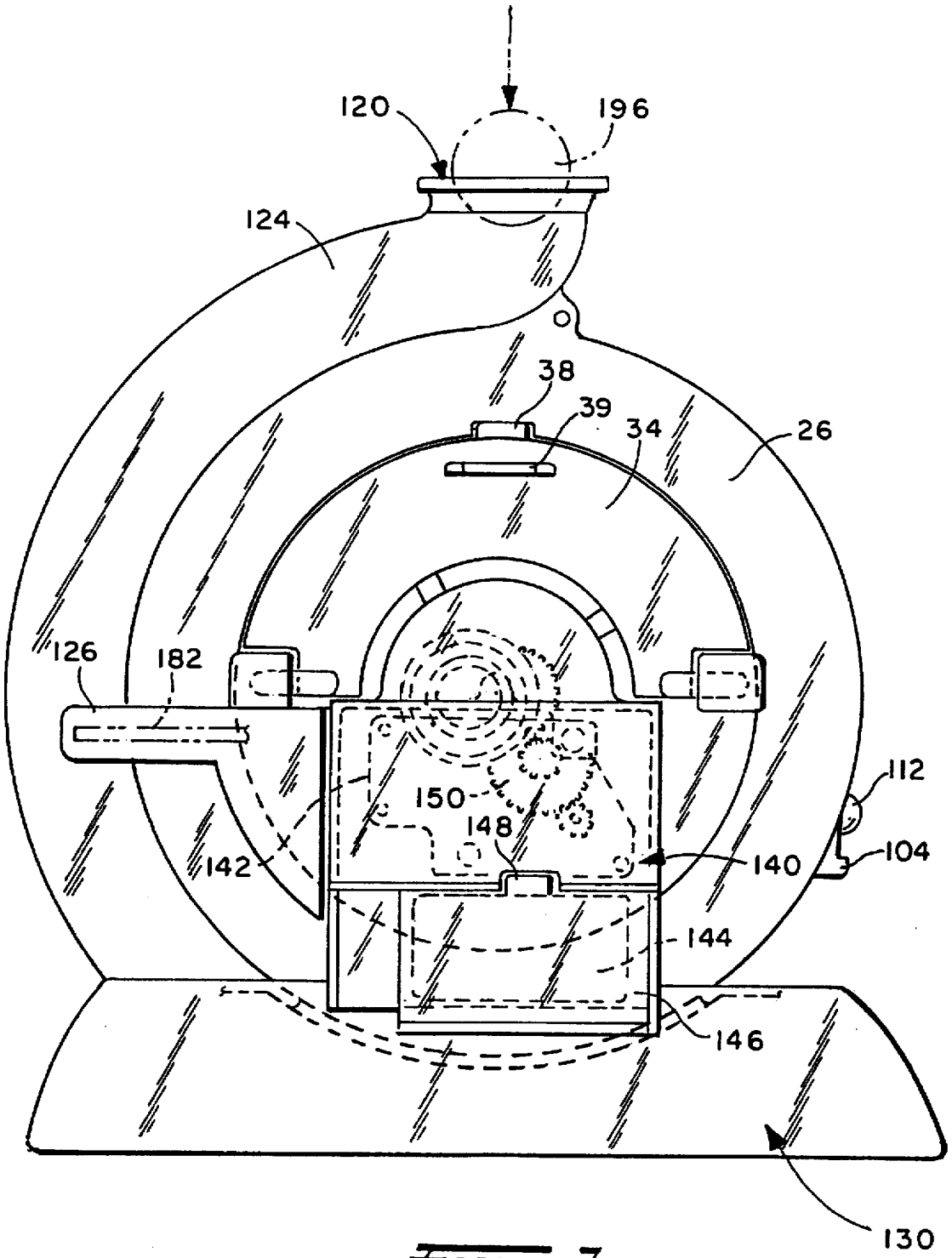
FIG. 3 is a back elevation view of the invention as disclosed in FIG. 1.

As shown in FIGS. 1–3, confection housing 22 is mounted on top of bank housing 130. Bank housing 130 includes a bank chamber 132 and a bank door 134 which provides access to bank chamber 132. Bank door 134 preferably includes a door latch 136 which secures bank door 134 in a closed position. As can be appreciated, latch 136 can be substituted for a lock to provide additional security to bank chamber 132. Bank door 134 is preferably located at the base of bank housing 130. The base of bank housing 130 is generally flat to provide stability to the dispenser during operation.

Figure 4:
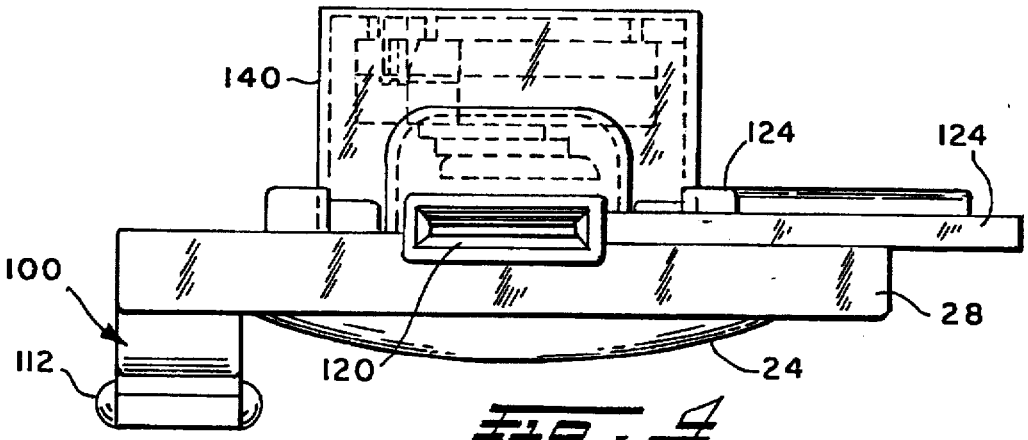
FIG. 4 is a top view taken along line 4—4 of FIG. 1.

Referring now to FIGS. 1, 3 and 4, dispenser 20 includes a coin slot which extends from the top of confection housing 22 to the top of bank housing 130. Coin slot 120 includes a slot opening 122 which is sized to allow coins to be entered through the slot opening. Connected to slot opening 122 is a slot passageway 124 which extends about the outer surface 28 of housing 22 and terminates at the top of bank housing 130. The slot passageway is designed to direct coins which are passed through slot opening 122 into bank chamber 132. As shown in FIG. 3, slot passageway 124 includes a lever slot 126 wherein a lever arm 182 intersects slot passageway 124. Lever arm 182 is positioned in slot passageway 124 such that a coin traveling through slot passageway 124 will contact lever arm 182. As described more fully below, lever arm 182 is part of a mechanism which controls the movement of carriage 50 within housing 22.

Referring now to FIGS. 2–4, dispenser 20 includes a motor housing 140 which is mounted on the back face 26 of housing 22 and on the top of bank housing 130. Motor housing 140 encases a motor 142, a power source 144 and a gearing arrangement which controls the rotation of carriage 50 within chamber 30. Motor 142 is preferably an electric motor which is powered by an electric power source 144. Power source 144 is typically a battery. A power source door 146 provides access to power source 144 to allow a user to insert a new power source when necessary. The power source door is secured in the closed position by door latch 148.

Figure 6:
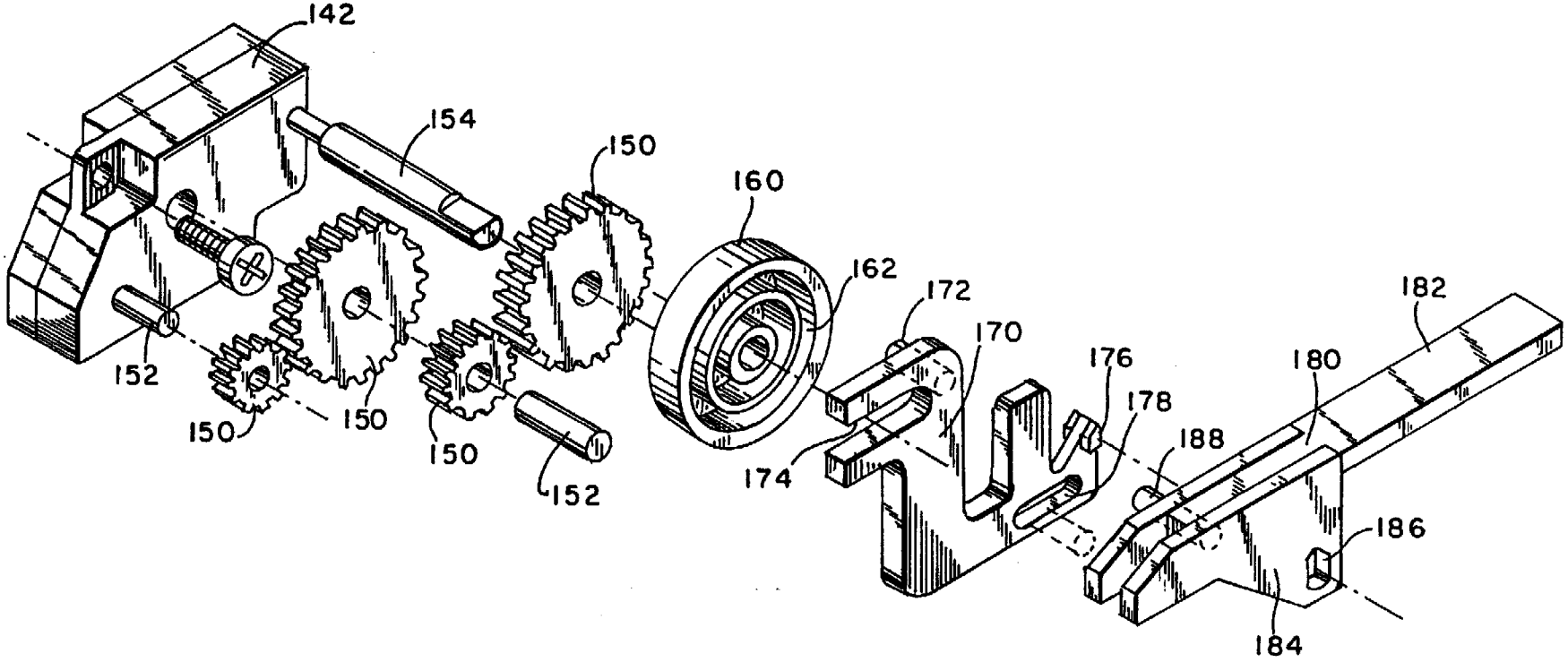
FIG. 6 is an exploded view of the motor and gear arrangement of the invention disclosed in FIG. 1.

Referring now to FIG. 6, several motor gears 150 are attached to motor 142 by gear rods 152. Attached to one of motor gear 150 is carriage shaft 154. Carriage shaft 154 extends from motor gear 150 through cam wheel 160 into carriage connection member hole 74. Carriage shaft 154 rotates carriage 50 within chamber 30 when motor 142 has been activated. Cam wheel 160 includes a perimeter slot 162 wherein a support pin 172 on lever support 170 is inserted therein. The cam wheel 160 is mounted on carriage shaft 154 to provide lateral movement to lever support 170 as cam wheel 160 is rotated by carriage shaft 154. The lateral movement is produced by cam pin 172 on lever support 170 being guided in perimeter slot 162 of cam wheel 160 as cam wheel rotates. Lever support 170 includes a shaft slot 174 which maintains lever support 170 in a proper position. Shaft slot 174 is designed to allow lever support 170 to move to and from carriage shaft 154 as cam wheel 160 moves lever support 170. Lever support 170 also includes a guide slot 178 which receives guide pin 179. Guide pin 179 is mounted onto motor housing 140. Both shaft slot 174 and guide slot 178 limit the movement of lever support 170 in the lateral direction relative to motor 142.

Lever support 170 also includes support nodes 176 which are designed to secure lever 180 onto lever support 170. Lever 180 includes two lever sleeves 184 in parallel relationship to one another. These lever sleeves include a sleeve notch 186 which receive support nodes 176 of lever support 170 thereby attaching lever 180 to lever support 170. The connection between lever 180 and lever support 170 provides for pivotable movement of lever 180 relates to lever support 170. Lever 180 includes lever arm 182 which extends into lever slot 126 to intersect slot passageway 124. Lever 180 further includes a lever leg 188 which is designed to manipulate the position of electrical contact 190, as will be described in more detail below.

Figure 7:
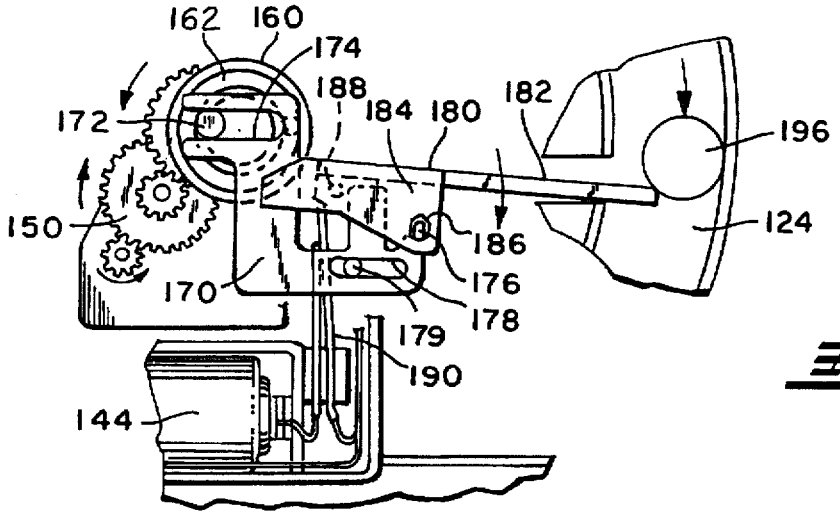
FIG. 7 is a partial view of the present invention illustrating a coin activating the movement mechanism.

The operation of the candy dispenser disclosed in FIGS. 1–9 will now be described. Prior to using dispenser 20, reservoir 40 is filled with confectionery pieces 21. Confectionery pieces 21 are placed into reservoir 40 by opening door 34 located on the back face of housing 22. Door 34 is opened by the user depressing door handle 39 which releases door latch 38. Once reservoir 40 has been filled, door 34 is secured in the closed position. If a power source 144 is not already provided in motor housing 140, the user must open power source door 146 via door latch 148 and insert a power source into the motor housing. Confectionery pieces are dispensed from reservoir 40 by the user inserting a coin 196 into coin slot 120. Because the components of dispenser 20 are preferably transparent or semi-transparent, the operator visually observes coin 196 moving through slot passageway 124. The coin continues through slot passageway 124 until engaging lever arm 182 in lever slot 126. The impact of coin 196 on the end of lever arm 122 causes lever arm 182 to pivot downwardly. The downward movement of lever arm 182 causes lever leg 188 to pivot upwardly as shown in FIG. 7. The upward movement of leg 188 causes leg 188 to disengage from electric contact 190 thereby allowing contact 190 to engage with another electric contact positioned closely adjacent thereto. The engagement of the two electrical contacts closes the electric circuit which energizes motor 142.

The activation of motor 142 causes carriage shaft 154 to begin rotating. The rotation of carriage shaft 154 in turn causes carriage 50 to rotate within chamber 30. As carriage 50 rotates about the perimeter of chamber 30, carriage well 69, filled with confectionery pieces 21, moves about the perimeter of chamber 30. When carriage well 69 nears the top of chamber 30, one or more confectionery pieces 21 may fall from well 69 and drop back into confection reservoir 40. This dropping of the confectionery pieces enhances the visual effects of the operation of the dispenser 20. Once carriage well 69 reaches the top of chamber 30, chamber shelf 80 prevents any further confectionery pieces 21 from exiting carriage well 69. As can be appreciated, shelf 80 can be extended to prevent any confectionery pieces from dropping out of well 69. Motor 142 continues to cause carriage 50 to move about chamber 30 thereby moving well 69 toward dispenser opening 90. When well 69 nears opening 90, gravity causes the confectionery pieces in well 69 to move toward and onto carriage ramp 66. The confectionery pieces are deposited through dispenser opening 90 and into dispenser housing 100 when the leading edge of carriage well 69 passes by dispenser opening 90. The confection is directed through dispenser opening 90 by carriage ramp 66.

The operator retrieves the confectionery pieces dispensed in dispenser housing 100 by grasping nodules 112 on lower chamber 104 and lifting the lower chamber away from lower shelf 106 thereby removing the confection within dispenser housing 100 as shown in FIG. 5.

After the confectionery pieces are dispensed from carriage well 69, motor 142 continues to rotate carriage 50 until carriage well 69 is positioned at the base of confection chamber 30. Once well 69 reaches the base of chamber 30, motor 142 stops the rotation of carriage 50. Carriage well 69 is automatically refilled with any confectionery pieces 21 remaining in reservoir 40 by gravity which causes the confectionery pieces in the reservoir to fall through slot 68 and into well 69.

Figure 8:
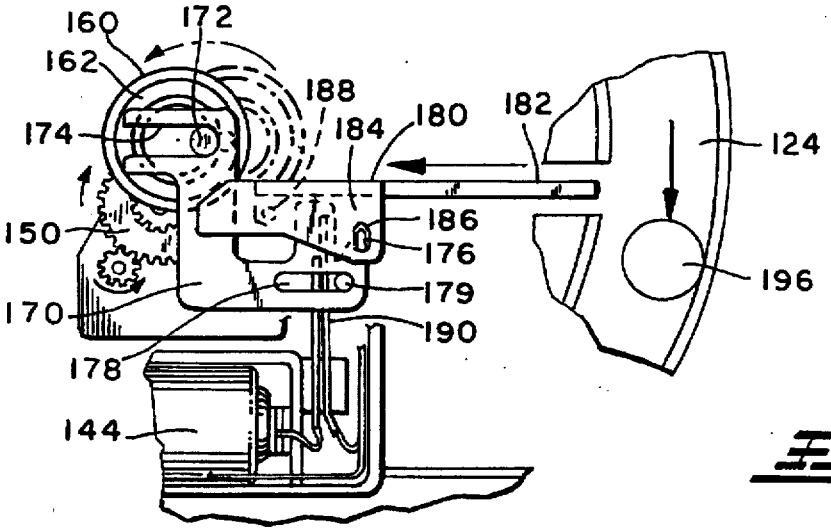
FIG. 8 is a partial sectional view of the present invention which illustrates the coin proceeding down the coin passageway after the coin has activated the movement mechanism.
Figure 9:
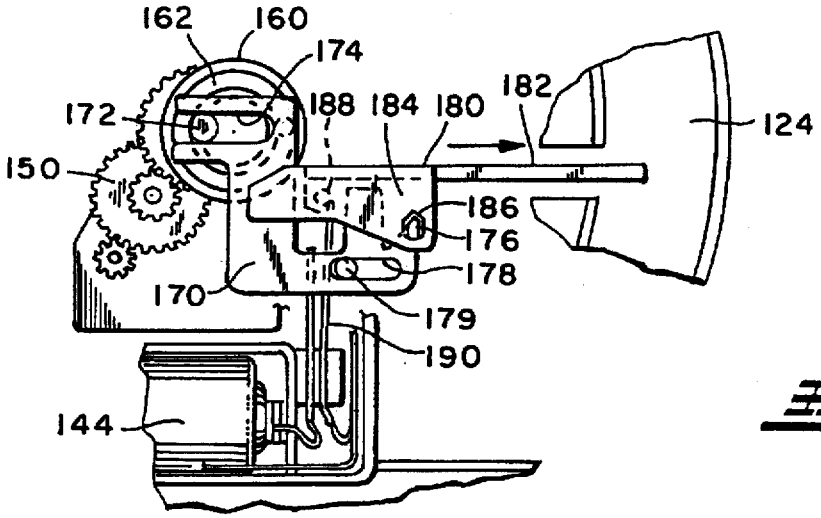
FIG. 9 is a partial sectional view of the present invention as shown in FIG. 1 and illustrates the movement mechanism resetting to its initial position.

The mechanism whereby coin 196 activates motor 142 to cause carriage 50 to rotate a single revolution within chamber 30 will now be described. Referring now to FIGS. 7–9, coin 196 upon contacting lever arm 182 causes lever 180 to pivot on lever support 170. The pivoting of lever 180 causes lever leg 188 to disengage from electric contact 190. This disengagement allows electrical contact 190 to move into contact with an adjacent electric contact thereby closing the circuit between power source 144 and motor 142. As motor 142 begins to turn carriage shaft 154 thereby causing carriage 50 to rotate within candy chamber 30, the carriage shaft simultaneously rotates cam wheel 160. As cam wheel 160 rotates, the cam wheel causes lever supports 170 and lever 180 to retract from slot passageway 124 as disclosed in FIG. 8. Once lever 180 is sufficiently retracted from slot passageway 124, coin 196 is allow to continue to move within slot passageway 124 until the coin terminates in bank chamber 132. The release of coin 196 from lever arm 182 allows the lever arm to pivot upwardly on lever support 170 as shown in FIG. 8. The cam wheel after a half rotation, begins moving lever support 170 and lever 180 toward slot passageway 124. This movement of lever support 170 and lever 180 continues until lever leg 188 engages electrical contact 190 thereby causing the electrical contact to disengage from the adjacent electrical contact. This disengagement of the two electrical contacts breaks the circuit between the power source 140 and motor 142 thereby causing motor 142 to terminate operation. Cam wheel 160 is designed such that only one revolution of the cam wheel is needed to retract and reengage lever support 170 and lever 180. The single revolution of cam wheel 160 also results in the single revolution of carriage 50 within chamber 30.

Figure 10:
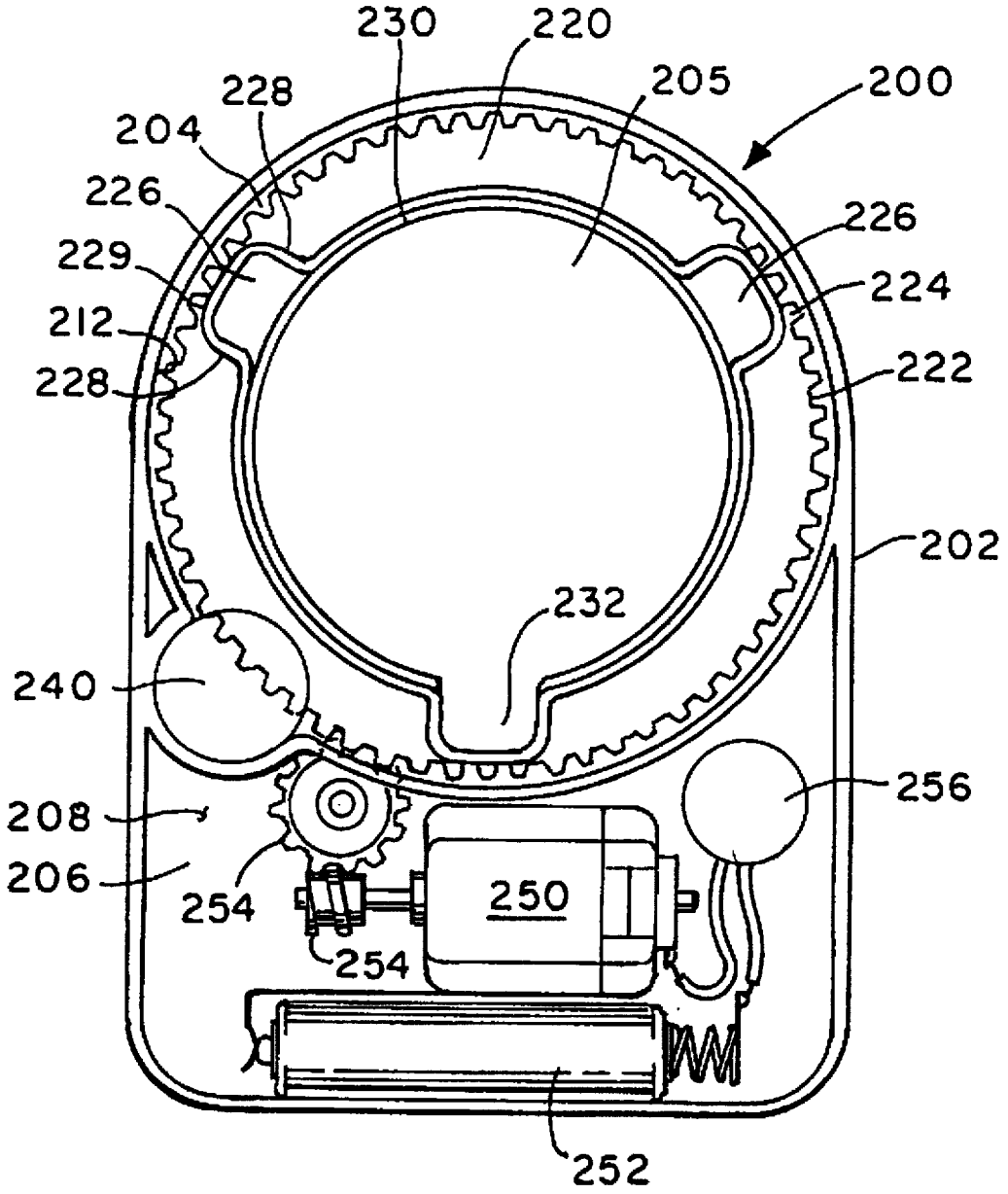
FIG. 10 is a plane elevation view of a modification of the present invention; and, FIG. 11 is a plane elevation view of a confection dispenser and illustrates still another modification of the present invention.
Figure 11:
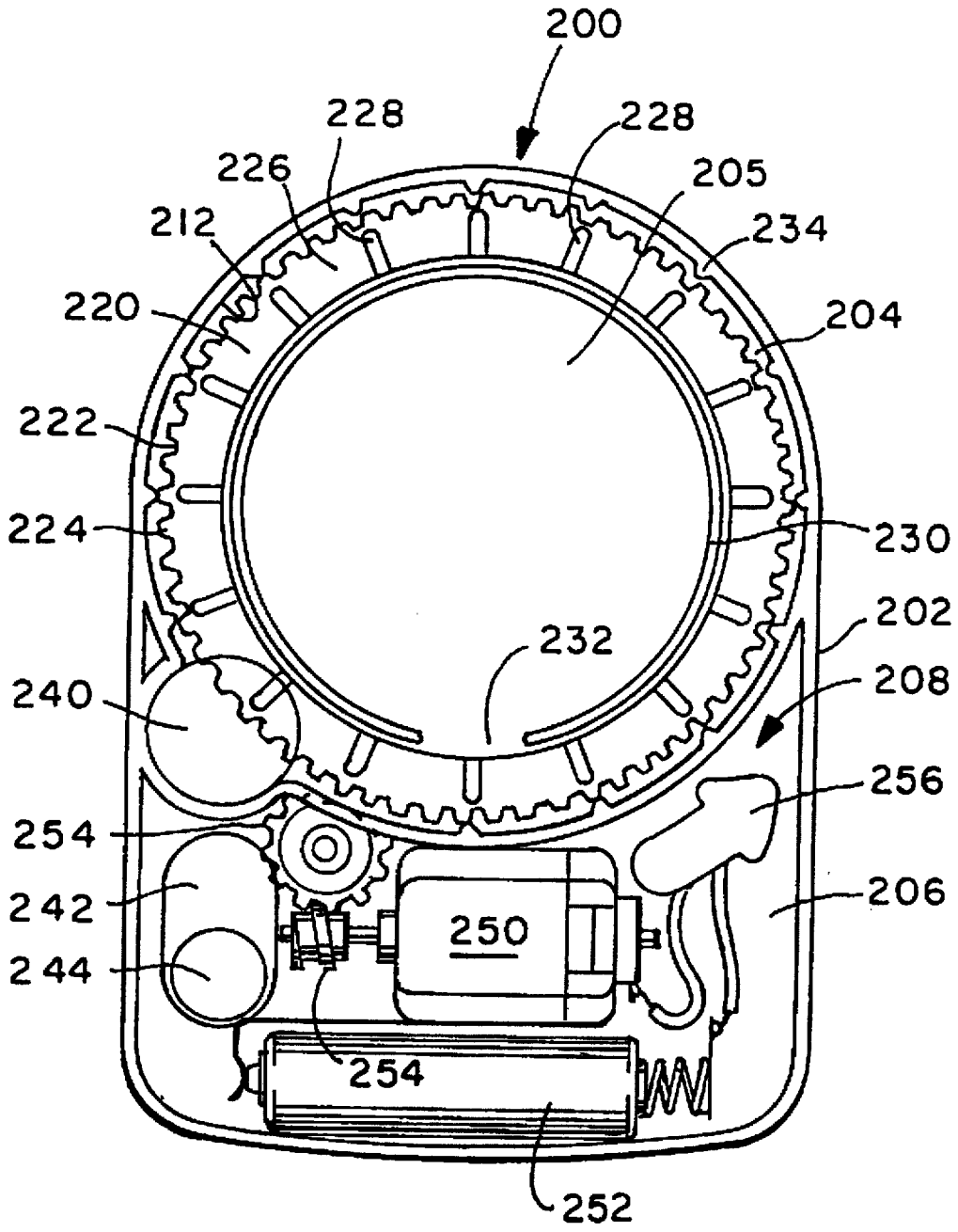

Referring now to FIGS. 10 and 11 which disclose a portable dispenser which is a modification of the preferred embodiment described above, portable dispenser 200 includes a dispenser housing 202 which encloses a chamber 204 and a motor chamber 206. Within chamber 204 there is a rotatable circular shaped carriage 220 positioned between chamber inner surface 212 and chamber shelf 230. Carriage 220 includes several sprockets 224 positioned on the carriage peripheral edge 222. As shown in FIG. 10, carriage 220 includes three carriage wells 226, wherein each carriage well is defined by two carriage partitions 228 and a well base 229 connected between the two carriage partitions. As will be appreciated, fewer or greater number of carriage wells can be incorporated into carriage 220. In FIG. 11, carriage 220 is absent any well base 229 but includes additional carriage partitions to create a multiple number of carriage wells 226. The radius of carriage 220 is preferably about 0.5–2 inches, however, other dimensions may be used. The distance between the carriage partitions is preferably about 0.25–2.5 inch, but other dimensions may be employed.

Chamber shelf 230 is generally circular in shape and defines reservoir 205. A shelf slot 232 is located in chamber shelf 230 near the base of chamber 204. Shelf slot 232 provides a passageway between reservoir 205 and carriage well 226. When dispenser housing 202 is propped in at least a partially upright position, gravity causes any confectionery pieces within the reservoir 205 to fall into a well 226 which is in aligned with shelf slot 232. A dispenser opening 240 is positioned on the housing front face 208 and thereby allows confectionery pieces in carriage well 226 to be deposited through the dispenser housing 202 to the user. Dispenser opening 204 is positioned on the dispenser housing to provide a passageway between the outer surface of the dispenser housing and carriage 220. The chamber inner surface 212 may also include one or more inner surface nodes 234 as shown in FIG. 11. These inner surface nodes help maintain carriage 220 in its proper position such that sprockets 223 properly engage motor gear 254. As previously discussed, chamber shelf 230 also maintains carriage 220 in a proper position as carriage 220 rotates about chamber shelf 230.

Within motor chamber 206, there is a motor 250. The motor may be a mechanical spring or electric motor. Preferably, motor 250 is an electrical motor powered by a power source 252. The motor chamber also includes one or more motor gears 254. The motor gears are positioned in motor chamber 206 to rotate carriage 220 when motor 250 is actuated. On the face of housing 202, there is located a switch 256 which upon depressing, completes the electrical contact between power source 252 and motor 250. Once the motor is activated, the motor causes gear 254 to engage sprockets 224 thereby rotating carriage 220 within candy chamber 204. The rotation of carriage 220 in turn causes one or more of the carriage wells 226 to rotate about candy chamber 204 and dispense candy through dispenser opening 240.

As shown in FIG. 11, a dispenser door 242 may be incorporated in the dispenser housing to open and close the dispenser opening 240. A door nodule 244 is attached to the base of the door to allow a user to slide the door nodule upwardly thereby causing the dispenser door to close the dispenser opening. To open the dispenser opening, the user moves door nodule 244 downwardly thereby sliding dispenser door 242 away from dispenser opening 240. Although not shown, one or more accesses may be provided in dispenser housing 202 to allow the user to re-fill reservoir 205 with confectionery pieces and/or to allow the user to replace power source 252.

The invention has been described with reference to preferred embodiments and alternates thereof. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

We claim:

1. A dispenser for dispensing a confection comprising of a confection chamber having an outer perimeter, a dispenser opening and a conveyance mechanism, said conveyance mechanism including a confection carriage which rotates about said outer perimeter of said confection chamber and a drive mechanism which moves said confection carriage about said outer perimeter of said confection chamber, said confection carriage includes an outer peripheral edge and said drive mechanism engages said confection carriage substantially at said outer peripheral edge, said drive means includes a drive actuator for activating said drive mechanism and an electric motor, said drive actuator includes a coin slot, a coin passageway, and a coin detector, said coin detector activating said drive mechanism upon detection of a coin in said coin passageway.

2. A dispenser as defined in claim 1, wherein said outer perimeter of said confection chamber is substantially circular and said confection carriage having a substantially circular inner perimeter.

3. A dispenser as defined in claim 2, wherein said substantially circular inner perimeter of said confection carriage having a central axis and said drive mechanism being connected to said confection carriage substantially at said central axis.

4. A dispenser as defined in claim 1, including a coin repository for collecting coins inserted into said coin slot.

5. A dispenser for dispensing a confection comprising of a confection chamber having an outer perimeter, a dispenser opening and a conveyance mechanism, said conveyance mechanism including a confection carriage which rotates about said outer perimeter of said confection chamber and a drive mechanism which moves said confection carriage about said outer perimeter of said confection chamber, said confection carriage includes at least one confection well adapted to receive said confection from said confection chamber, said confection chamber includes a confection barrier adapted to prevent said confection from passing between said confection chamber and said confection carriage, said confection barrier being positioned at said outer perimeter of as confection chamber, said outer perimeter of said confection chamber being substantially circular and said confection carriage having a substantially circular inner perimeter, said substantially circular inner perimeter of said confection carriage having a central axis and said drive mechanism being connected to said confection carriage substantially at said central axis, said drive means includes a drive actuator for activating said drive mechanism and an electric motor, said drive actuator includes a coin slot, a coin passageway, and a coin detector, said coin detector activating said drive mechanism upon detection of a coin in said coin passageway.

6. A dispenser as defined in claim 5, including a coin repository for collecting coins inserted into said coin slot.

7. A dispenser as defined in claim 5, wherein said coin detection includes a coin lever adapted to block movement of said coin through said coin passageway until said confection carriage at least partially conveys said confection to said dispenser opening.

8. A dispenser for dispensing a confection comprising of a confection chamber having an outer perimeter, a dispenser opening and a conveyance mechanism, said conveyance mechanism including a confection carriage which rotates about said outer perimeter of said confection chamber and a drive mechanism which moves said confection carriage about said outer perimeter of said confection chamber, said confection carriage includes at least one confection well adapted to receive said confection from said confection chamber, said confection chamber includes a confection barrier adapted to prevent said confection from passing between said confection chamber and said confection carriage, said confection barrier is positioned at said outer perimeter of as confection chamber, wherein said outer perimeter of said confection chamber is substantially circular and said confection carriage having a substantially circular inner perimeter, said confection carriage includes an outer peripheral edge and said drive mechanism engages said confection carriage substantially at said outer peripheral edge, said drive means includes a drive actuator for activating said drive mechanism and an electric motor, said drive actuator includes a coin slot, a coin passageway, and a coin detector, said coin detector activating said drive mechanism upon detection of a coin in said coin passageway.

9. A dispenser as defined in claim 8, including a coin repository for collecting coins inserted into said coin slot.

10. A dispenser as defined in claim 8, wherein said coin detection includes a coin lever adapted to block movement of said coin through said coin passageway until said confection carriage at least partially conveys said confection to said dispenser opening.

11. A dispenser for dispensing a confection comprising of a confection chamber having an outer perimeter, a dispenser opening and a conveyance mechanism, said conveyance mechanism including a confection carriage which rotates about said outer perimeter of said confection chamber and a drive mechanism which moves said confection carriage about said outer perimeter of said confection chamber, said confection carriage includes at least one confection well adapted to receive said confection from said confection chamber, said confection chamber includes a confection slot adapted to allow said confection to pass from said confection chamber to said confection well as said confection well passes by said confection slot, and said confection barrier adapted to prevent said confection from re-entering said confection chamber after said confection well as past said confection slot, said confection barrier is positioned at said outer perimeter of as confection chamber, said outer perimeter of said confection chamber is substantially circular and said confection carriage having a substantially circular inner perimeter, said substantially circular inner perimeter of said confection carriage having a central axis and said drive mechanism being connected to said confection carriage substantially at said central axis, said drive means includes a drive actuator for activating said drive mechanism and an electric motor, said drive actuator includes a coin slot, a coin passageway, and a coin detector, said coin detector activating said drive mechanism upon detection of a coin in said coin passageway.

12. A dispenser as defined in claim 11, including a coin repository for collecting coins inserted into said coin slot.

13. A dispenser as defined in claim 11, wherein said coin detection includes a coin lever adapted to block movement of said coin through said coin passageway until said confection carriage at least partially conveys said confection to said dispenser opening.

14. A dispenser for dispensing candy comprising a confection chamber for holding confection pieces, said chamber generally cylindrical in shape and having an outer peripheral edge, a first and second side and a central axis through said surfaces and a refill opening positioned in said first side surface, a dispenser opening, conveyance mechanism adapted to move said confection pieces from said confection chamber to said dispenser opening and a drive actuator for activating a drive mechanism, said conveyance mechanism including a circular carriage positioned about said confection chamber which rotates about said chamber central axis, said circular carriage having at least one confection well adapt to receive said confection from said confection chamber, said confection chamber includes a confection barrier, adapted to prevent said confection from passing between said confection chamber and said confection carriage, said confection barrier being positioned at said outer perimeter of as confection chamber, said drive actuator includes a coin slot, a coin passageway, and a coin detector, said coin detector activating said drive mechanism upon detection of a coin in said coin passageway.

15. A dispenser as defined in claim 14, wherein said coin detection includes a coin lever adapted to block movement of said coin through said coin passageway until said confection carriage at least partially conveys said confection to said dispenser opening.

16. A method of dispensing a confection comprising the steps of:

a) providing a confection chamber adapted to hold a confection, said confection chamber having an outer peripheral edge;

b) providing a dispenser opening;

c) providing a confection carriage adapted to convey said confection from said confection chamber to said dispenser opening, said confection carriage including at least one confection well adapted to hold said confection in said confection carriage;

d) providing a confection barrier positioned substantially at said peripheral edge of said confection chamber adapted to prevent said confection from passing between said confection chamber and said confection carriage, said confection barrier at least partially encircling said confection chamber;

e) rotating said confection carriage about said peripheral edge of said confection chamber until said confection well in said confection barrier is at least substantially aligned with said confection slot to allow at least one of said confection in said confection chamber to pass into said confection well;

f) continuing said rotation of said confection carriage until said confection well is at least substantially aligned with said dispenser opening;

g) including the step of providing a drive mechanism and a drive actuator, said drive mechanism adapted to rotate said confection carriage about said confection chamber, said drive actuator adapted to activate said drive mechanism; and h) placing a coin in said drive actuator to move said confection carriage about said confection chamber.

17. A method of dispensing a confection comprising the steps of:

a) providing a confection chamber adapted to hold a confection, said confection chamber having an outer peripheral edge;

b) providing a dispenser opening;

c) providing a confection carriage adapted to convey said confection from said confection chamber to said dispenser opening, said confection carriage including at least one confection well adapted to hold said confection in said confection carriage;

d) providing a confection barrier positioned substantially at said peripheral edge of said confection chamber adapted to prevent said confection from passing between said confection chamber and said confection carriage, said confection barrier at least partially encircling said confection chamber;

e) rotating said confection carriage about said peripheral edge of said confection chamber until said confection well in said confection barrier is at least substantially aligned with said confection slot to allow at least one of said confection in said confection chamber to pass into said confection well;

f) continuing said rotation of said confection carriage until said confection well is at least substantially aligned with said dispenser opening;

g) including the step of providing a confection slot in said confection barrier adapted to allow said confection to passing from said confection chamber to said confection carriage;

h) including the step of providing a drive mechanism and a drive actuator, said drive mechanism adapted to rotate said confection carriage about said confection chamber, said drive actuator adapted to activate said drive mechanism, including the step of depressing a switch on said drive actuator to selectively move said confection carriage about said confection chamber; and, i) placing a coin in said drive actuator to move said confection carriage about said confection chamber.

* * * * *